US006524149B1

(12) United States Patent
Hattori

(10) Patent No.: US 6,524,149 B1
(45) Date of Patent: Feb. 25, 2003

(54) COOLED OIL RESERVOIR FOR WATERCRAFT

(75) Inventor: Toshiyuki Hattori, Shizuoka (JP)

(73) Assignee: Yamaha Hatsudoki Kabushiki Kaisha (JP)

( * ) Notice: Subject to any disclaimer, the term of this patent is extended or adjusted under 35 U.S.C. 154(b) by 0 days.

(21) Appl. No.: 09/291,027

(22) Filed: Apr. 13, 1999

(30) Foreign Application Priority Data

Apr. 13, 1998 (JP) ..... 10-101126

(51) Int. Cl.[7] ..... B63H 21/10
(52) U.S. Cl. ..... 440/88
(58) Field of Search ..... 440/38, 88; 184/104.2; 123/196 AB

(56) References Cited

U.S. PATENT DOCUMENTS 3,292,373 A * 12/1966 Tado ..... 440/88
3,301,230 A * 1/1967 Ito
4,984,528 A 1/1991 Kobayashi
5,366,397 A 11/1994 Suganuma et al.
5,507,673 A 4/1996 Boggia
5,536,189 A * 7/1996 Mineo ..... 440/89
5,634,832 A * 6/1997 Nakase et al. ..... 440/88
5,647,315 A 7/1997 Saito
5,797,378 A 8/1998 Kato
5,839,930 A 11/1998 Nanami et al.
5,887,564 A * 3/1999 Kawamoto ..... 123/196 R

* cited by examiner

*Primary Examiner*—Ed Swinehart
(74) *Attorney, Agent, or Firm*—Knobbe Martens Olson & Bear LLP

(57) ABSTRACT

A watercraft having a cooling system for the lubrication system of the engine, the cooling system including a reservoir, at least a portion of the reservoir being cooled by ambient water flowing through a cooling jacket in contact with the reservoir. Also disclosed is a watercraft having a cooling system for the lubrication system of the engine, the cooling system including a reservoir, at least a portion of the reservoir being cooled by direct and/or thermal contact with ambient water in which the watercraft floats.

19 Claims, 10 Drawing Sheets

COOLED OIL RESERVOIR FOR WATERCRAFT

BACKGROUND OF THE INVENTION

1. Field of the Invention

The present invention generally relates to a cooling system for a lubricating system of an internal combustion engine. More particularly, the present invention relates to a cooling system for a lubricating system of a watercraft engine that powers a water propulsion device.

2. Description of Related Art

Personal watercraft have become very popular in recent years. An enthusiasm for competition has grown with this popularity, and as a result personal watercraft have become increasingly fast. Many personal watercraft today are capable of speeds well in excess of 60 miles per hour. To attain such speeds, such watercraft are typically driven by high power output motors.

Two-cycle engines commonly power personal watercrafts, as these engines have the advantage of being fairly powerful and relatively light and compact. One particular disadvantage of two-cycle engines though is emission content. Two-cycle engines exhaust large quantities of carbon monoxide and various hydrocarbons. However, when steps are taken to reduce the emission content of a two-cycle engine, other generally undesirable consequences result, such as an increase in the weight of the engine and reduction of its power output.

Four-cycle engines have now been proposed as the power plant for personal watercrafts. These engines have the advantage of less hydrocarbon emission than a two-cycle engine while maintaining a relatively high power output.

It is therefore desirable to provide a watercraft with a four-cycle engine in order to reduce exhaust emissions without significantly impacting the power output of the engine that powers the watercraft.

SUMMARY OF THE INVENTION

The present invention involves in part the recognition that several problems arise in connection with employing a four-cycle engine within a personal watercraft. One such problem involves the fact that four-cycle engines are generally arranged with oil-filled crankcases or reservoirs positioned at the bottom of the cylinder block. When this type of engine is mounted in a personal watercraft, the associated oil pump may not consistently draw oil from the crankcase as the oil sloshes from side to side with abrupt maneuvers of the watercraft. In addition, because of the confined space of the engine compartment and a desire to inhibit water influx into the water compartment, the engine typically runs hot. Running such a motor at a very high output exacerbates the heat of the engine. If the motor is continuously run in this manner, the lubricants viscosity will break down and will not be able to properly cool and lubricate the engine. In extreme cases, viscosity breakdown can result in the engine overheating and seizure.

The present invention therefore provides a lubrication system with a cooling system so as to prevent overheating of the lubricant and viscosity breakdown of the lubricant.

One aspect of the present invention therefore involves a small watercraft comprising a hull with an engine compartment, and an internal combustion engine, located within the hull, which has an output shaft. A propulsion device is carried by the hull and is driven by the engine output shaft to propel the watercraft. The engine also includes a lubrication system including a pump and a reservoir, the lubrication system circulating lubricant between the engine and the reservoir. A cooling jacket, in contact with at least a portion of the reservoir, draws heat away from the reservoir, thereby cooling the reservoir and the lubricant contained therein.

In accordance with a further aspect of the present invention, a watercraft is provided comprising a hull with an engine compartment, and an internal combustion engine, located within the hull, which has an output shaft. A propulsion device is carried by the hull and is driven by the engine output shaft to propel the watercraft. The engine also includes a lubrication system including a pump and a reservoir, the lubrication system circulating lubricant between the engine and the reservoir. At least a portion of the reservoir is in direct contact with the ambient fluid in which the watercraft floats, such that the ambient fluid is able to absorb heat from the reservoir, thereby cooling the reservoir and the lubricant contained therein.

In accordance with a further aspect of the present invention, a watercraft is provided comprising a hull with an engine compartment, and an internal combustion engine, located within the hull, which has an output shaft. A propulsion device is carried by the hull and is driven by the engine output shaft to propel the watercraft. The engine also includes a lubrication system including a pump and a reservoir, the lubrication system circulating lubricant between the engine and the reservoir. At least a portion of the reservoir is contact with a material having good heat-transfer characteristics, this material also being in contact with the ambient fluid in which the watercraft floats, such that the material transfers heat from the reservoir to the ambient fluid, thereby cooling the reservoir and the lubricant contained therein.

Further aspects, features, and advantages of the present invention will become apparent from the detailed description of the preferred embodiments which follow.

BRIEF DESCRIPTION OF THE DRAWINGS

The above-mentioned and other features of the invention will now be described with reference to the drawings of preferred embodiments of the present watercraft. The illustrated embodiments of the watercraft are intended to illustrate, but not to limit the invention. The drawings contain the following figures.

DETAILED DESCRIPTION OF PREFERRED EMBODIMENTS OF THE INVENTION

Figure 1:
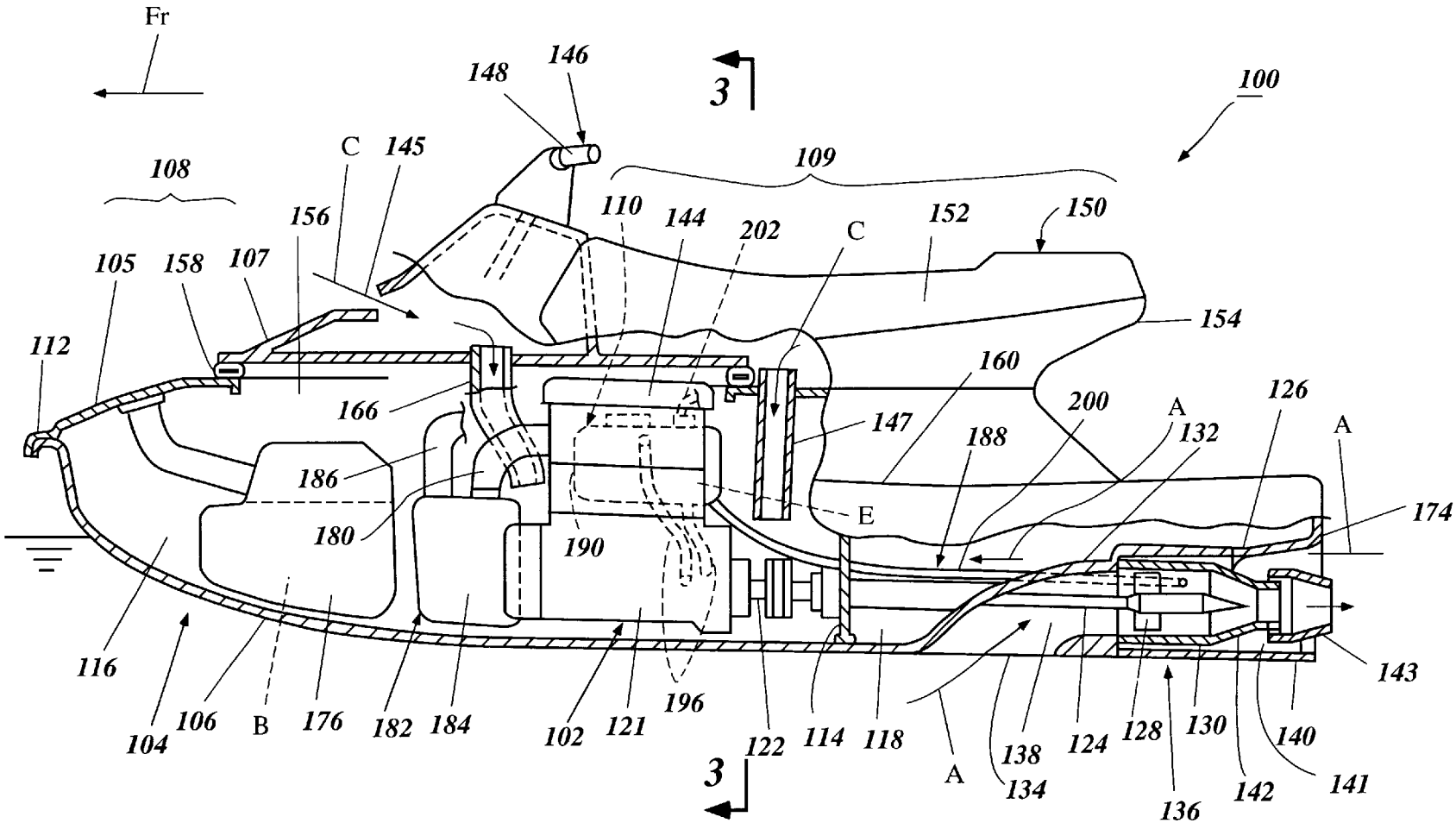
FIG. 1 is a partial sectional side view of a personal watercraft with a lubrication cooling system configured in accordance with a preferred embodiment of the present invention.

With reference to FIG. 1, a portion of a small watercraft, indicated generally by the reference numeral 100, is partially illustrated in cross-section. The watercraft 100 includes an arrangement of an engine 102 and a lubrication cooling system 110 within a hull 104 of the watercraft 100 in accordance with a preferred embodiment of the present invention. The engine 102 and lubrication cooling system 110 are arranged within the hull 104 in a manner which enhances the cooling of the engine lubrication. As a result, cooling of the lubrication results in a lower probability of lubrication viscosity break down thus reducing the chance of complete engine seizure.

Although the present invention is illustrated and described with reference to the illustrated embodiments, various other engine types and configurations may also be used with the present invention. Moreover, it is understood that the lubrication cooling system 110 can be used with other types of watercraft as well, for example, but without limitation, jet boats and the like.

The following describes the illustrated watercraft in reference to a coordinate system in order to ease the description of the watercraft. A longitudinal axis extends from bow to stem and a lateral axis from port side to starboard side normal to the longitudinal axis. In addition, relative heights are expressed in reference to the undersurface of the watercraft. And in FIG. 1, a label "$F_R$" is used to denote the direction the watercraft travels during normal forward operation.

Before describing the lubrication cooling system 110 within the watercraft 100, an exemplary personal watercraft 100 will first be described in general detail to assist the reader's understanding of the environment of use. The watercraft 100 has a hull, indicated generally by reference numeral 104. The hull 104 can be made of any suitable material; however, a presently preferred construction utilizes molded fiberglass reinforced resin. The hull 104 generally has a lower hull section 106 and an upper deck section 108. A bond flange or gunnel 112 may connect the lower hull section 106 to the upper deck section 108. Of course, any other suitable means may be used to interconnect the lower hull section 106 and the upper deck section 108. Additionally, the lower hull section 106 and the upper deck section 108 may be integrally formed.

As viewed in the direction from the bow to the stem of the watercraft, the upper deck section 108 includes a bow portion 105, an engine access cover 107, and a rider's area 109. The engine access cover 107 includes a control mast 146 supporting a handlebar assembly 148. The handlebar 148 controls the steering of the watercraft 100 in a conventional manner. The handlebar assembly also carries a variety of controls of the watercraft 100, such as, for example, a throttle control, a start switch and a lanyard switch.

The rider's area 109 lies behind the control mast 146 and includes a seat assembly 150. In the illustrated embodiment, the seat assembly 150 has a longitudinally extending straddle-type seat which may be straddled by an operator and by at least one or two passengers. The seat assembly 150, at least in principal part, is formed by a seat cushion 152 supported by a raised pedestal 154. The raised pedestal 154 forms a portion of the upper deck section 108, and has an elongated shape that extends longitudinally along the center of the watercraft 100. The seat cushion 152 desirably is removably attached to a top surface of the raised pedestal 154 by one or more latching mechanisms (not shown) and covers the entire upper end of the pedestal 154 for rider and passenger comfort.

An engine access opening 156 is located in the upper surface of the upper deck section 108. The access opening 156 opens into an engine compartment 116 formed within the hull 104. The engine access cover 107 normally covers and seals closed the access opening 156. If desired, a seal 158, such as a rubber gasket, can be sandwiched between the access cover 107 and the bow portion 105 to ensure the access opening 156 is closed in a watertight manner. When the engine access cover 107 is removed, the engine compartment 116 of the hull 104 is accessible through the access opening 156.

The upper deck section 108 of the hull 104 advantageously includes a pair of level planes 160 positioned on opposite sides of the aft end of the upper deck section 108. The level planes 160 define a pair of foot areas that extend generally longitudinally and parallel to the sides of the pedestal 154. In this position, the operator and any passengers sitting on the seat assembly 150 can place their feet on the foot areas during normal operation of the personal watercraft 100. A non-slip (e.g., rubber) mat desirably covers the foot areas to provide increased grip and traction for the operator and passengers.

The hull 104 also includes one or more bulkheads 114 which may be used to reinforce the hull internally and which also may serve to define, in part, the engine compartment 116 and the propulsion compartment 118. The engine 102 is mounted within the engine compartment 116 in any suitable manner. For instance, a set of resilient engine mounts 208 may be used to connect the engine 102 to a set of stringers 210. The engine is desirably mounted in a central transverse position. The engine 102 may be of any known configuration. For example, the engine 102 may be a two-stroke, four-stroke or rotary type of engine. Additionally, the engine 102 may comprise any number of cylinders. The illustrated engine is a four-stroke engine having four cylinders. The illustrated engine type, however, is merely exemplary.

A forward air intake 145 is formed into the upper surface of the engine access cover 107, which allows atmospheric air C to enter an air intake box 164 formed in the interior of the engine access cover 107. A forward air duct 166 is disposed in a lower surface of the air intake box 164, the inlet end of the forward air duct 166 desirably lies above the lower surface of the air intake box 164 to reduce the amount of water passing into the forward air duct 166. Atmospheric air C from the air intake box 164 travels down the forward air duct 166 into the engine compartment 116. Similarly, a rear air duct 147 is disposed in the upper surface of the pedestal 154, preferably underneath the seat cushion 152, and atmospheric air C travels through the rear air duct 147 into the engine compartment 116. Except for the air ducts 166 and 147, the engine compartment 116 is normally substantially sealed so as to enclose the engine 102 of the watercraft 100 from the body of water in which the watercraft 100 is operated.

Figure 3:
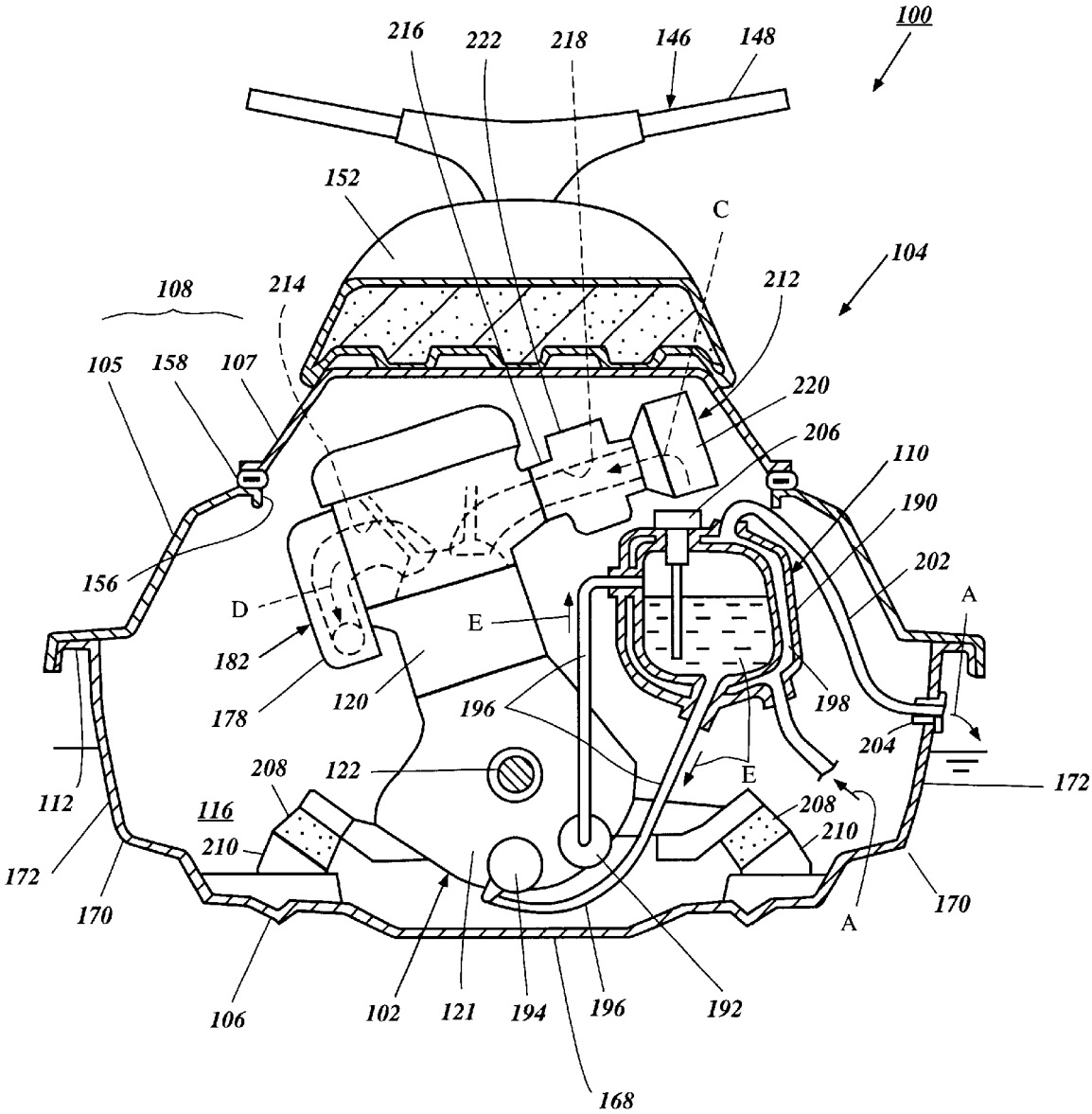
FIG. 3 is a cross-sectional view of the watercraft of FIG. 1 taken along line 3—3, with a schematic illustration of the lubricant flow path through the lubrication cooling system.

The lower hull section 106 is designed such that the watercraft 100 planes or rides on a minimum surface area of the aft end of the lower hull section 106 in order to optimize the speed and handling of the watercraft 100 when up on plane. For this purpose, as best seen in FIG. 3, the lower hull section 106 generally has a V-shaped configuration formed by a pair of inclined sections that extend outwardly from the keel line 168 to outer chimes 170 at a dead rise angle. The inclined sections extend longitudinally from the bow toward the transom 174 of the lower hull section 106 and extend outwardly to side walls 172 of the lower hull section 106. The side walls 172 are generally flat and straight near the stem of the lower hull section 106 and smoothly blend towards the longitudinal center of the watercraft 100 at the bow. The lines of intersection between the inclined section and the corresponding side wall 172 form the outer chines 170 of the lower hull section 106. The lower hull section 106 can also include additional chines between the keel line 168 and the outer chines 170 for improved handling, as known in the art.

Toward the transom of the watercraft 100, the inclined sections of the lower hull section 106 extend outwardly from a recessed channel or tunnel 132 that extends upward towards the upper deck section 108. The tunnel 132 has a generally parallelepiped shape and opens through a transom 174 of the watercraft 100.

In the illustrated embodiment, a jet pump unit 126 propels the watercraft 100. The jet pump unit 126 is mounted within the tunnel 132 formed on the underside of the lower hull section 106 by a plurality of bolts (not shown). An intake duct 132 extends between the jet pump unit 126 and an inlet opening 134 that opens into a gullet 138. The duct 132 leads to an impeller housing.

A steering nozzle 143 is supported at the downstream end of the discharge nozzle 142 by a pair of vertically extending pivot pins (not shown). In an exemplary embodiment, the steering nozzle 143 has an integral level on one side that is coupled to the handlebar assembly 148 through, for example, a bowden-wire actuator, as known in the art. In this manner, the operator of the watercraft 100 can move the steering nozzle 143 to effect directional changes of the watercraft 100.

A ride plate 140 covers a portion of the tunnel 136 behind the inlet opening 134 to enclose the jet pump unit 126 within the tunnel 136. In this manner, the lower opening of the tunnel 136 is closed to provide a planing surface for the watercraft 100. A pump chamber 141 then is defined within the tunnel section covered by the ride plate 140.

An impeller shaft 124 supports the impeller 128 within the impeller housing 130. The aft end of the impeller shaft 124 is suitably supported and journalled within the compression chamber of the housing 130 in a known manner. The impeller shaft 124 extends in a forward direction through a bulkhead 114. A protective casing surrounds a portion of the impeller shaft 124 that lies forward of the intake gullet 138.

The engine 102 powers the impeller shaft 124. The engine 102 is positioned within the engine compartment 116 and is mounted primarily beneath the control mast 146. As previously noted, vibration absorbing engine mounts 208 secure the engine 102 to the lower hull section 106. The engine is mounted in approximately the centerline of the watercraft 100.

A fuel supply system delivers fuel B to the engine 102 in a manner known in the art. The fuel supply system includes a fuel tank 176 located in front of the engine 102. Although not illustrated, at least one pump desirably delivers fuel from the fuel tank 176 to the engine 102 through one or more fuel lines.

The engine 102 typically draws air from the engine compartment 116 through an engine air intake system 212. In the disclosed embodiment, the engine air intake system comprises an engine air intake 220 positioned on the upper starboard side of the engine 102, which passes air C from the engine compartment 116 to an air intake manifold 222 and carburetor 216, which supply a fuel/air charge to a plurality of engine cylinders (not shown) through intake passages 218 in a known manner. Of course, other arrangements, such as direct or indirect fuel injection, could be used to provide a fuel charge to the engine 102.

The engine exhaust system 182 typically comprises an exhaust manifold 178 which transfers exhaust gases D exiting the combustion chamber (not shown) through exhaust passages 214 to an engine exhaust pipe 180. The exhaust manifold 178 thus generally comprises a merge chamber and a plurality of exhaust runner passages (not shown) as known in the art. The engine exhaust pipe 180 transfers exhaust gases D to a watertrap 184. The watertrap 184 is a well known device that allows the passage of exhaust gases, but contains baffles (not shown) which prevent water A from passing back through the engine exhaust pipe 180 into the engine 102. In the present embodiment, the watertrap 184 is located in front of the engine 102, slightly forward of the forward air duct 166. This positioning of the watertrap 184 allows atmospheric air C travelling into the engine compartment through the forward air duct 166 to cool the outer surfaces of the watertrap 184, thereby reducing the transfer of heat from the watertrap 184 to the engine 102. The watertrap transfers exhaust gases D to a watercraft exhaust pipe 186. The watercraft exhaust pipe 186 passes along the port side of the engine 102, and discharges the exhaust gases D to the pump chamber 141 and the atmosphere. Desirably, at least one section of the watercraft exhaust pipe 186 is positioned higher than the watertrap 184 and the pump chamber 141, such that the passage of water A through the atmospheric exhaust pipe 186 into the watertrap 184 is further inhibited.

As previously noted, the engine 102 desirably is an internal combustion engine of a known four-stroke variety. Because the engine is conventional, the internal details of the engine are not believed necessary for an understanding of the present lubrication cooling system 110.

In the illustrated embodiment, the lubrication cooling system 110 includes a pair of pumps 192, 194, and a reservoir 190. The first pump 194 draws lubricant from the reservoir through a lubricant line 196 and pumps it through lubricant galleries in the engine 102 to lubricate the engine 102 in a conventional manner. The lubricant then drains into a crankcase 121 of the engine 102 where the second pump 192 delivers the lubricant from the engine 102 back to the reservoir 190 through a lubricant line 196. The arrows along the lubricant lines 196 illustrate the direction of the lubricant flow through the lubrication system. In order to ensure that sufficient lubricating fluid E is maintained in the reservoir, the reservoir incorporates a dipstick filler cap 206, which can be removed to check the oil level and/or fill the reservoir 190 as necessary. This cap 206 seals the reservoir 190 closed under normal operating conditions.

While the lubricant is circulating through the lubrication cooling system 110 as described above, the reservoir 190 is desirably exposed to a flow of an ambient cooling fluid A supplied by a fluid delivery system 188 for cooling the reservoir 190. As best seen in FIG. 3, voids 198 in the walls of the reservoir 190 allow the ambient cooling fluid A to pass through the walls of the reservoir 190, drawing heat away from the walls of the reservoir 190 and cooling the reservoir while isolating the lubrication fluid E from the ambient cooling fluid A. Desirably, the reservoir 190 is comprised of a material that is highly conductive to heat transfer, such as metal, which allows heat in the lubricating fluid E to easily pass through the walls of the reservoir 190 and into the ambient cooling fluid A.

The cooling fluid delivery system 188 comprises a cooling fluid supply line 200 which supplies cooling fluid A from the impeller housing 130 to the reservoir 190. In the disclosed embodiment, the inlet of the cooling fluid supply line 200 is located aft of the impeller 128. The inlet (not shown), which can be a scoop-type inlet or simply an opening in the wall of the impeller housing 130, permits fluid A in the impeller housing 130 to travel through the supply line 200 into the reservoir 190. Because the fluid A in the impeller housing 130 is at a much greater pressure/velocity than the fluid A in the reservoir 190, at least some of the fluid in the impeller housing 130 will tend to travel through the supply line 200 into the reservoir 190. This arrangement obviates the need for pumps to supply ambient fluid A to the reservoir 190. However, if desired, auxiliary pumps can be used to provide a flow of cooling water to the reservoir 190.

The cooling fluid supply system 188 further comprises a cooling fluid return line 202 which connects the reservoir 190 to an overboard discharge fitting 204, allowing the heated cooling fluid A to discharge overboard. As previously noted, because the cooling fluid A entering the reservoir from the cooling fluid supply line 200 is at a higher pressure/velocity that fluid A in the reservoir 190, the heated cooling fluid A in the voids 198 of the reservoir 190 is forced out of the voids 198 and into the return line 202 where this fluid A is discharged through the overboard discharge fitting 204.

During use of the watercraft 100, cooling fluid A will travel through the cooling fluid supply system 188, cooling the reservoir 190 and the lubricating fluid located therein. At the same time, the forward motion $F_R$ of the watercraft 100, combined with the engine's use of atmospheric air C for combustion, will cause atmospheric air C to pass into the engine compartment. This air C also cools the outer surfaces of the reservoir 190, thereby further cooling the lubricating fluid E contained therein. In addition, the arrangement of the engine air intake 220 in the present embodiment further facilitates cooling of the reservoir 190—atmospheric air C will flow from the lower ends of the air intake ducts 166, 147, over the reservoir 190, and into the engine air intake 220.

Figure 2:
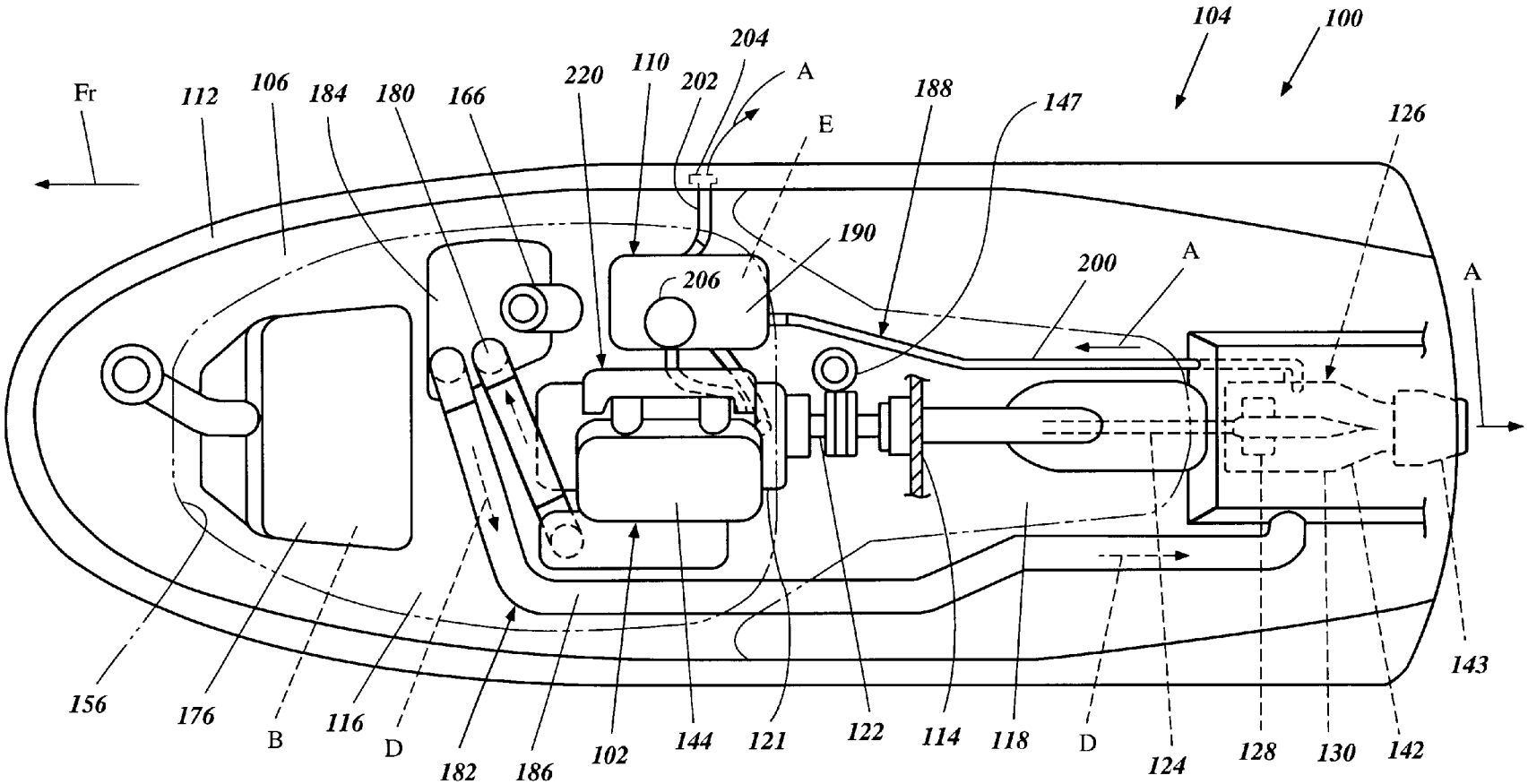
FIG. 2 is a sectional top plan view of the personal watercraft of FIG. 1, with various components of the watercraft illustrated in phantom.
Figure 4:
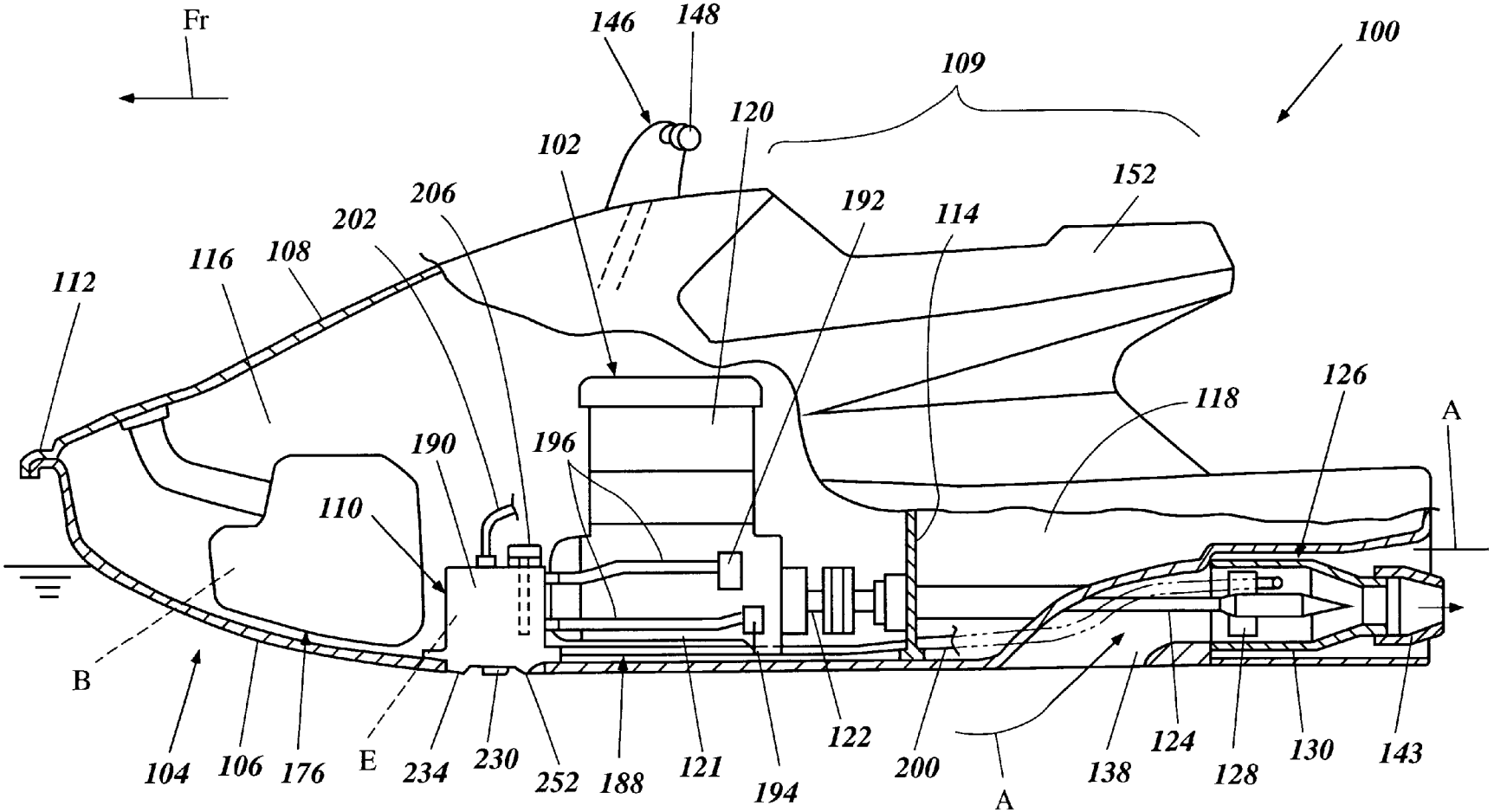
FIG. 4 is a partial sectional side view of a personal watercraft with a lubrication cooling system configured in accordance with another embodiment of the present invention.
Figure 5:
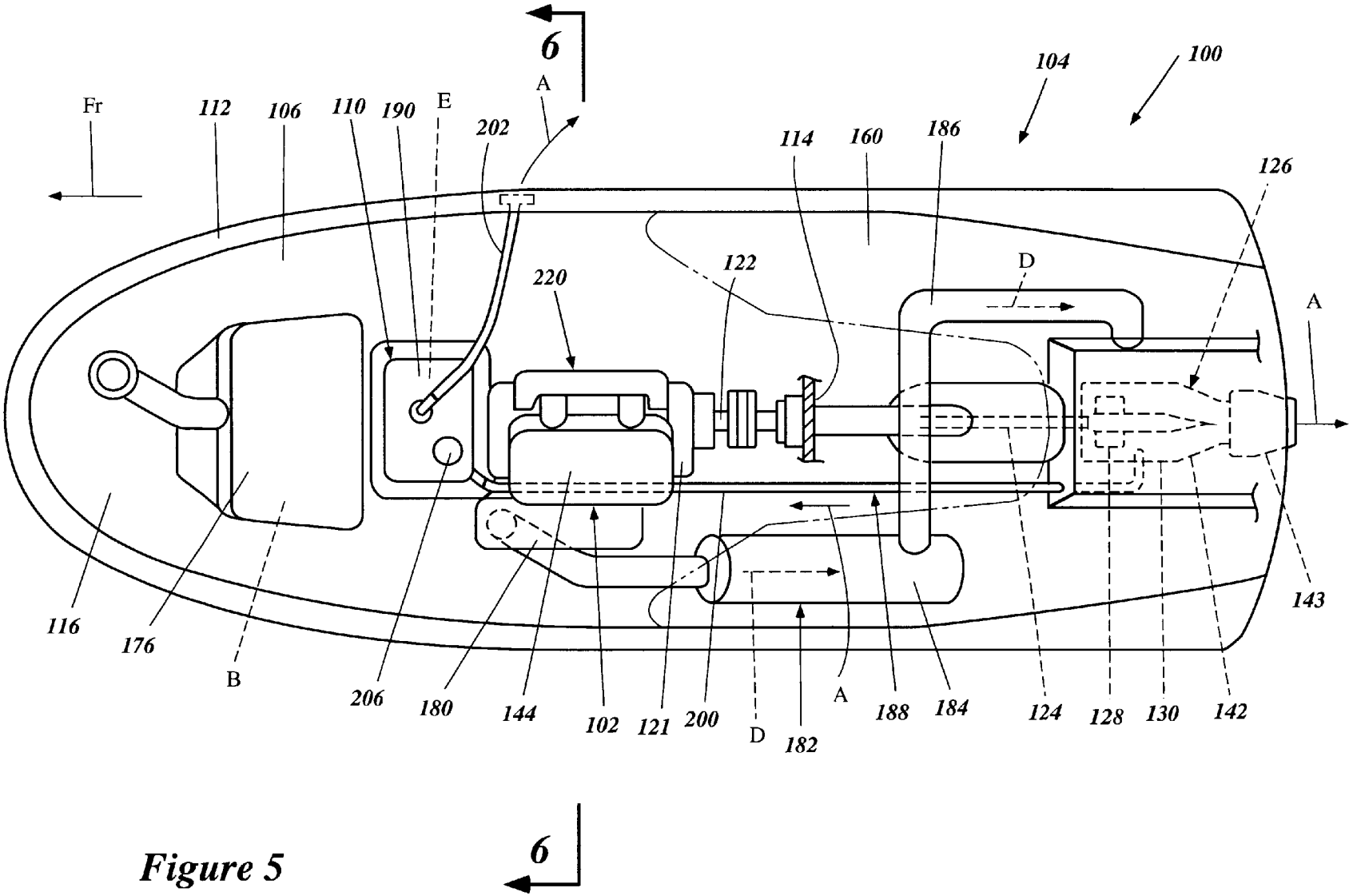
FIG. 5 is a sectional top plan view of the personal watercraft of FIG. 4, with various components of the watercraft illustrated in phantom.
Figure 6:
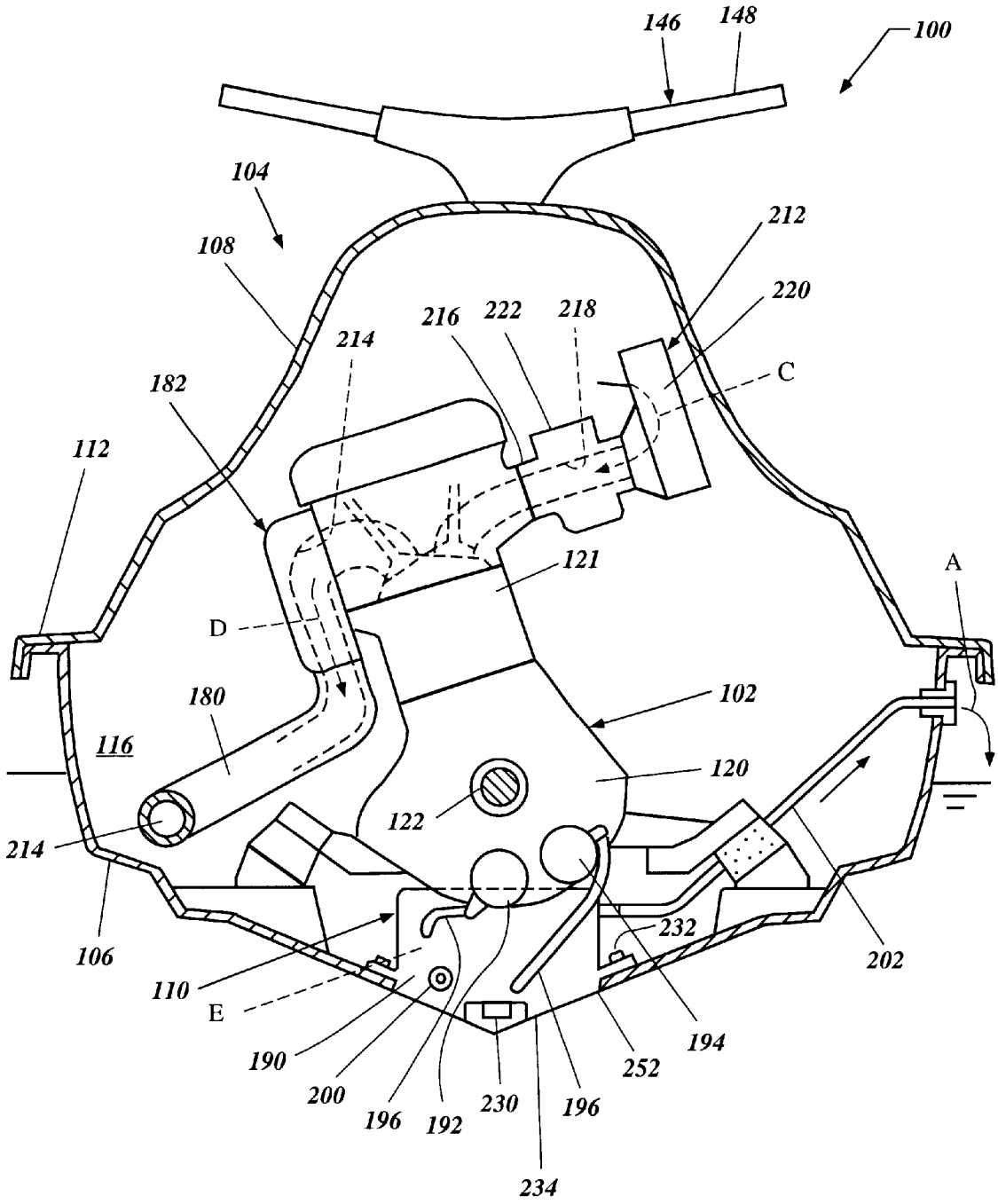
FIG. 6 is a cross-sectional view of the watercraft of FIG. 5 taken along line 6—6, with a schematic illustration of the lubricant flow path through the lubrication cooling system.

FIGS. 4–6 illustrate another embodiment of a lubrication cooling system 110 within a small watercraft 100 in accordance with a preferred embodiment of the present invention. The principal differences between the embodiment of FIGS. 1–3 and the embodiment of FIGS. 4–6 lie with the arrangement of the reservoir 190 and engine exhaust system 182 within the hull 104 of the watercraft 100. Therefore, for ease of description, similar features are ascribed the same reference numerals used for corresponding elements from the embodiments of FIGS. 1–3. Unless otherwise indicated, the above description of similar components should be understood as applying equally to the following embodiment.

As with the first embodiment, while the lubricant E is cycling through the lubrication cooling system 110, described above, the reservoir and lubricating fluid E contained therein is cooled by the cooling fluid delivery system 188. In the embodiment shown in FIGS. 4–6, the reservoir is positioned on the lower hull section 106 with the bottom surface 234 of the reservoir 190 extending through a hull opening 252 formed in the lower hull section 106. In this way, the bottom surface 234 of the reservoir 190 is in direct contact with the ambient fluid A. The reservoir 190 is desirably mounted in a watertight fashion to the lower hull section 106 by bolts 232 or other means well known in the art, and a conventional sealant, such as a rubber gasket, may be used to maintain the watertight integrity of the hull. The bottom surface 234 of the reservoir 190 is desirably formed in a broken V-shape, as best seen in FIG. 6, such that the smooth V-shaped outer surface of the lower hull section 106 is not interrupted. At the bottom of the reservoir 190, a drain plug 230 may be provided to allow easy draining of lubricating fluid from the reservoir 190 during maintenance of the watercraft 100.

In this embodiment, the arrangement of the engine exhaust system 182 is altered, with the watertrap 184 positioned aft of the engine 102. Aside from the change of position of the watertrap 184, however, the engine exhaust system 182 functions in essentially the same manner as previously described. Moreover, because the reservoir 190 is moved forward and away from the engine intake system 212, the engine air intake 220 may be altered to draw air C from a higher point in the engine compartment 116, thereby further reducing the possibility of the engine 102 ingesting water through the air intake 220 during normal operation of the watercraft 100.

The present embodiment provides for cooling of the lubrication fluid reservoir 190 by direct contact with the ambient fluid A. Thus, in this embodiment not only is the reservoir 190 cooled by fluid A from the cooling fluid delivery system 188, but the direct contact between the reservoir and the ambient fluid A provides for additional lubricant cooling by direct conduction through the bottom surface of the reservoir 190.

When the watercraft 100 of the present embodiment is operating at low speeds, the impeller 128 is typically rotating at a slow speed, with much of the lower hull section 106 of the watercraft 100 in contact with the ambient fluid A. This slow revolution of the impeller 128 typically results in a low fluid pressure in the impeller housing 130, which can consequently result in a reduced flow of cooling fluid A through the cooling fluid delivery system 188. Because there is less cooling fluid A passing through the cooling fluid delivery system 188, the reservoir 190 does not have as much cooling fluid A passing through it, which results in the lubricating fluid E experiencing an increased temperature as compared to the temperature of the fluid E during normal high-speed operation of the watercraft when the fluid pressure in the impeller housing 130/fluid flow through the reservoir 190 is much higher. However, because during slow speed operation the bottom surface of the reservoir 190 is in direct contact with the ambient fluid in the present embodiment, this direct contact significantly increases the amount of heat transferred directly through the bottom wall of the reservoir, thereby significantly reducing the need for the additional flow of cooling fluid through the lubrication cooling system 110.

When then speed of the watercraft increases, and the watercraft 100 goes up on plane, the bottom surface of the reservoir will typically be lifted out of the ambient fluid A, thereby reducing and/or eliminating direct contact between the ambient fluid A and the bottom surface of the reservoir 190. However, as previously noted, the increased fluid pressure in the impeller housing 130 will consequently greatly increase the flow of cooling fluid A through the lubrication cooling system, thereby increasing the flow of cooling fluid A through the reservoir 190 and reducing the need for heat transfer via direct contact between the reservoir 190 and the ambient fluid A.

Figure 7:
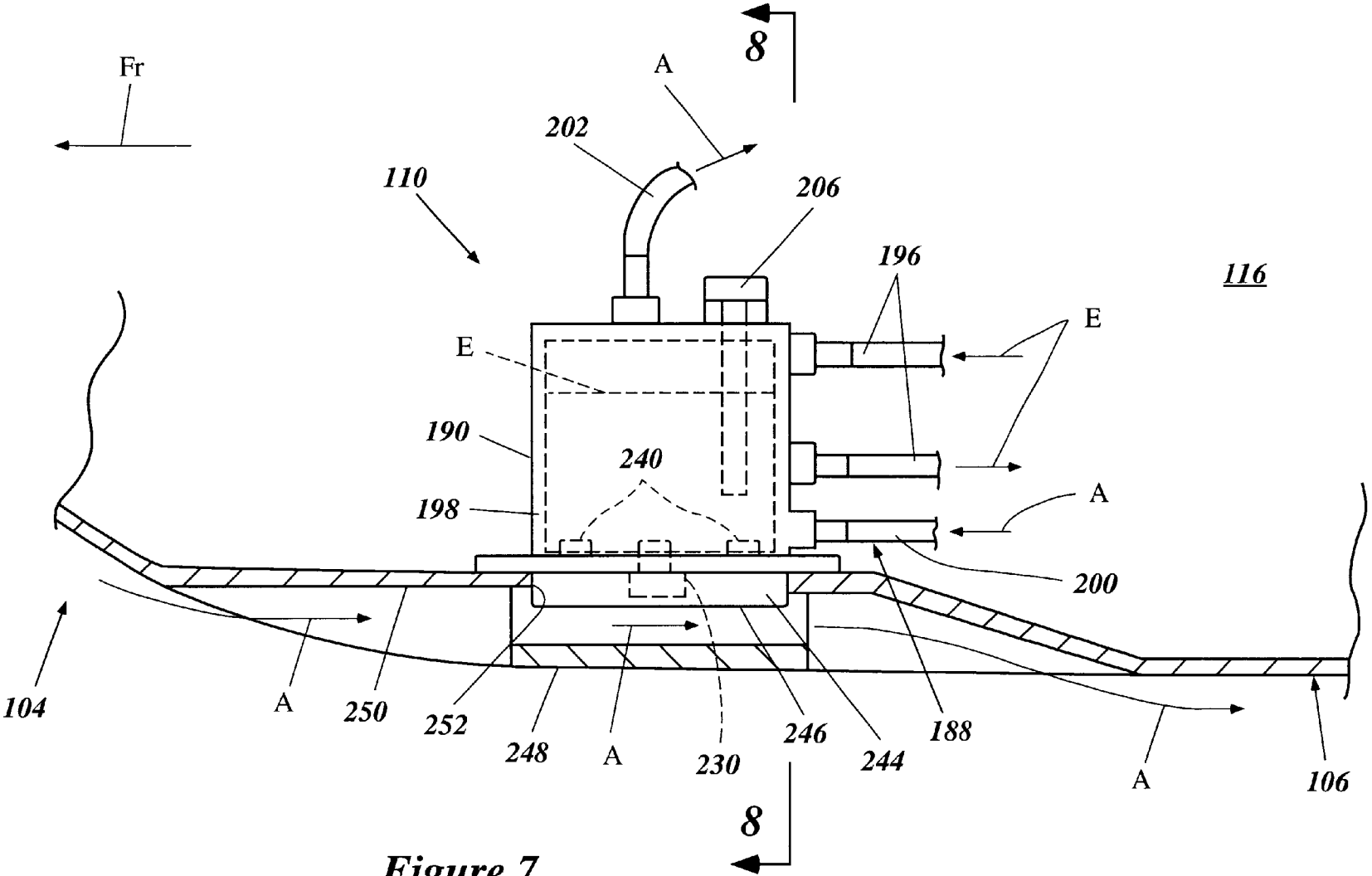
FIG. 7 is a partial cross-sectional side view of a personal watercraft with a lubrication cooling system configured in accordance with an additional embodiment of the present invention.
Figure 8:
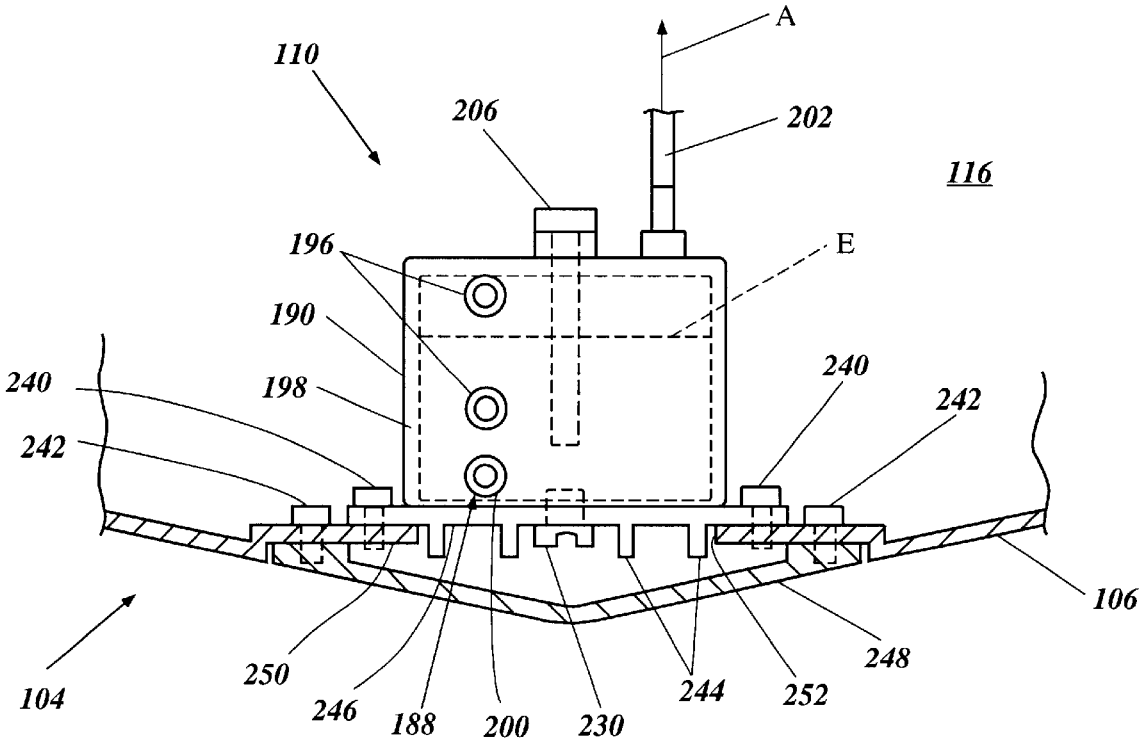
FIG. 8 is a partial cross-sectional view of the personal watercraft lubrication cooling system of FIG. 7 taken along line 8—8.

FIGS. 7 and 8 illustrate another embodiment of a lubrication cooling system 110 within a hull 104 of a small watercraft 100 in accordance with another preferred embodiment of the present invention. The principal difference between the embodiment of FIGS. 4–6 and the embodiment of FIGS. 7 and 8 lie with the arrangement and structure of the reservoir 190. Therefore, for ease of description, similar features are ascribed the same reference numerals used for corresponding elements from the embodiment of FIG. 4–6. Unless otherwise indicated, the above description of similar components should be understood as applying equally to the following embodiment.

As with the other embodiments, while the lubricant E is cycling through the lubrication cooling system 110, described above, the reservoir 190 and lubricating fluid E contained therein is cooled by the cooling fluid delivery system 188. In the embodiment shown in FIGS. 7 and 8, the reservoir is again positioned on the lower hull section 106 with an opening 252 formed in the lower hull section 106, beneath the bottom surface of the reservoir 190.

In this embodiment, however, the bottom surface 234 of the reservoir 190 does not directly contact the ambient fluid A. Instead, the bottom surface 234 of the reservoir 190 is desirably substantially flat, and is secured directly to a mounting plate 246 by welding or various other means well known in the art. The mounting plate 246 is desirably formed from a material having good heat-conductive qualities, such as metal or the like, and is secured by bolts 240 to a hull mounting section 250, the hull mounting section being a relatively flat surface formed in the lower hull section 106 located forward of the engine 102. The mounting plate 246 is secured to the hull mounting section 250 in a watertight fashion, as well known in the art, with one or more vanes 244 of the mounting plate 246 extend through the hull opening 252 formed in the hull mounting section 250. A V-shaped hull section 248 is desirably secured to the underside of the hull mounting section 250 by bolts 242 or the like. Desirably, the V-shaped hull section 248 will form a smooth continuation of the lower hull section 106, but will allow ambient fluid A to pass above the V-shaped hull section 248 and contact the mounting plate 246 during watercraft operation. Thus, in this embodiment, no special design for the bottom surface 234 of the reservoir 190 is required.

As with the previously described embodiment, the embodiment of FIGS. 7 and 8 allows for cooling of the lubrication fluid reservoir 190 by contact with the ambient fluid A. In this embodiment, however, the reservoir 190 is in thermal contact with the ambient fluid—heat from the reservoir 190 travels through the mounting plate 246 and into the ambient fluid A. Thus, not only is the reservoir 190 cooled by fluid A in the cooling fluid delivery system 188, but the thermal contact between the reservoir and the ambient fluid A allows for additional cooling through the bottom surface of the reservoir 190 and mounting plate 246 by conduction.

The further enhance heat transfer to the ambient fluid A, vanes 244 are formed on the lower surface of the mounting plate 246. The vanes act as heat sinks, and significantly increase the effective surface area of the mounting plate 246 in contact with the ambient fluid A, which increases in a known manner the amount of heat transfer possible between the reservoir and the ambient fluid A.

As discussed in connection with the previously described embodiment, the positioning of the reservoir 190 towards the bow of the watercraft allows for significant conductive cooling of the reservoir 190 and lubricant contained therein at lower watercraft speeds. In addition, this arrangement also provides additional protection for the bottom surface of the reservoir in the event of a collision with a floating objects. Because the mounting plate is recessed into the watercraft hull, and is protected from direct impact by the V-shaped hull section, it is unlikely that objects passing under the watercraft 100 will directly strike the bottom surface of the reservoir 190, damaging and or puncturing the reservoir 190 and/or vanes 244.

Figure 9:
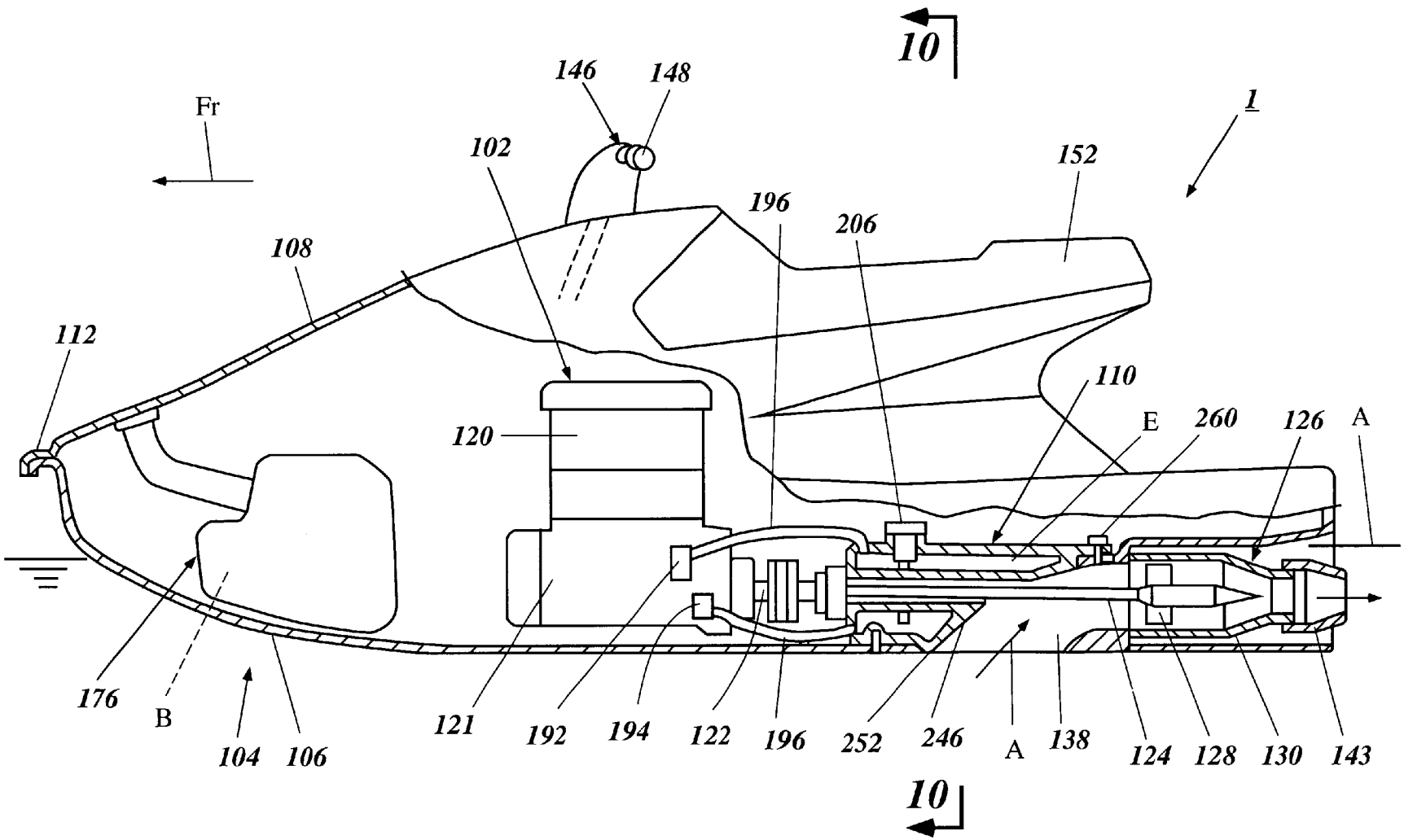
FIG. 9 is a partial cross-sectional side view of a personal watercraft with a lubrication cooling system configured in accordance with another embodiment of the present invention.
Figure 10:
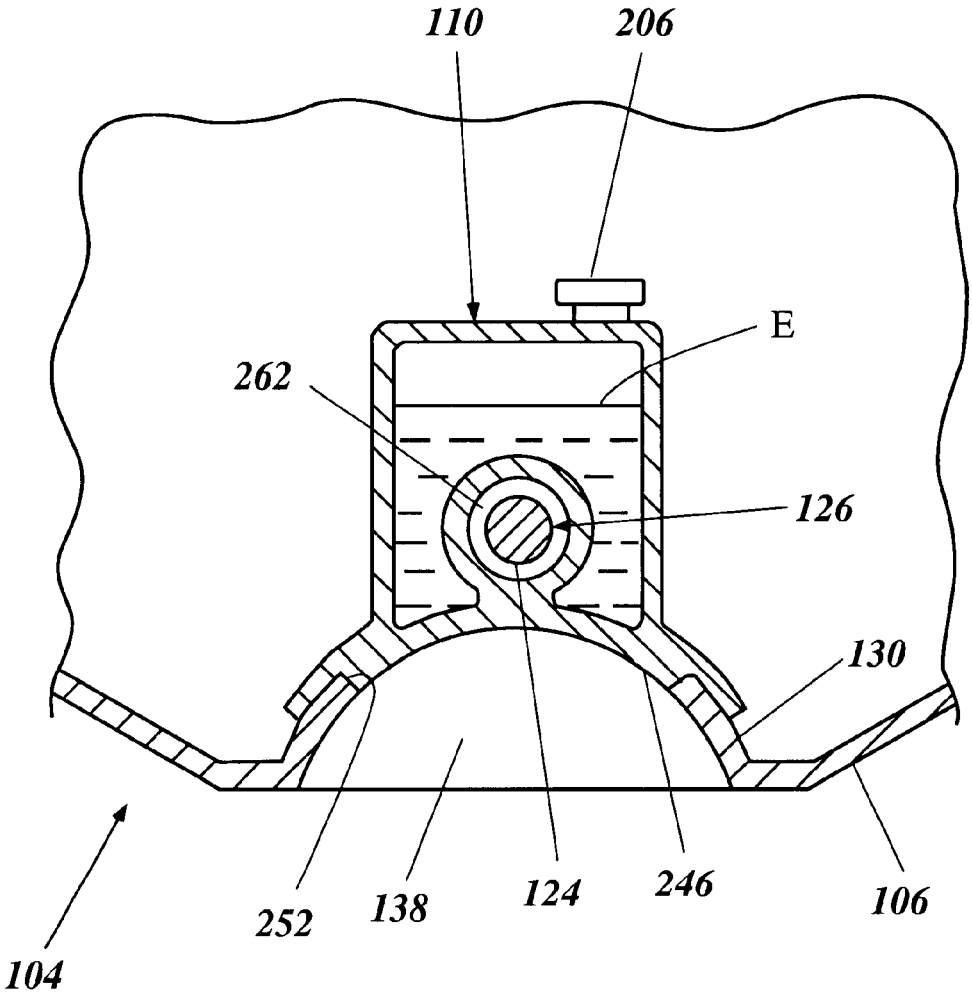
FIG. 10 is a partial cross-sectional view of the personal watercraft lubrication cooling system of FIG. 9 taken along line 10—10.

FIGS. 9 and 10 illustrate another embodiment of a lubrication cooling system 110 within a hull 104 of a small watercraft 100 in accordance with another preferred embodiment of the present invention. The principal difference between the embodiment of FIGS. 4–6 and the embodiment of FIGS. 9 and 10 lie with the arrangement and structure of the reservoir 190. Therefore, for ease of description, similar features are ascribed the same reference numerals used for corresponding elements from the embodiment of FIGS. 4–6. Unless otherwise indicated, the above description of similar components should be understood as applying equally to the following embodiment.

In this embodiment, as with the embodiments of FIGS. 4–6 and 7 and 8, while the lubricant E is cycling through the lubrication cooling system 110, described above, the reservoir and lubricating fluid E contained therein are cooled by conduction between the reservoir 190 and the ambient fluid A in which the watercraft 100 floats. In this embodiment, however, the reservoir is positioned on the lower hull section 106, with the bottom surface of the reservoir 190 forming at least a portion of the tunnel 136 of the jet pump unit 126.

The lower surface 246 of the reservoir 190 is formed in a curved, tubular shape such that, when the reservoir 190 is secured to the lower hull section 106 by bolts 260 in a watertight manner, the lower surface 246 and the lower hull section 106 form a tunnel 136 for the jet pump unit 126. A hull opening 252 is formed in the lower hull section 106 such that the lower surface 246 is in direct communication with ambient fluid A which passes through the tunnel 136.

Due the to position of the reservoir 190 in the present embodiment, the reservoir 190 incorporates a shaft opening 262 which permits the impeller shaft 124 to pass through the reservoir 190 so that the engine 102 can power the jet pump unit 126 of the watercraft 100 in a known manner. The forward end of the shaft opening 262 is desirably sealed in a known manner to prevent ambient fluid A from entering the engine compartment 116 while allowing the impeller shaft 124 to freely rotate.

Because the reservoir 190 in this embodiment is located aft of the engine 102, and forms a portion of the tunnel 136 of the jet pump unit 126, the reservoir 190 will remain in contact with the ambient fluid A throughout all watercraft speeds, even when the watercraft 100 is up on plane. This means that a substantial amount of heat can always be transferred by conduction between the reservoir 190 and the ambient fluid A passing through the jet pump unit 126. Accordingly, in this embodiment, a cooling fluid delivery system which specifically facilitates cooling of the reservoir 190 at higher watercraft speeds is not essential for proper operation of the lubrication cooling system 110.

Although this invention has been described in terms of certain embodiments, other embodiments apparent to those of ordinary skill in the art also are within the scope of this invention. Thus, various changes and modifications may be made without departing from the spirit and scope of the invention. For example, the present invention could be used in conjunction with a wet-sump-type engine lubricating system, with at least a portion of the wet-sump reservoir and lubricating fluid therein being cooled as disclosed herein. In addition, various combinations of the preferred embodiments are possible, with many combinations resulting in differing levels of cooling capacity in the reservoir. Accordingly, the scope of the invention is intended to be defined only by the claims that follow.

What is claimed is:

1. A small watercraft comprising a hull with an engine compartment defined therein, the hull having an opening formed on a lower section of the hull, an internal combustion engine mounted in the engine compartment and including a cylinder head, a water propulsion device powered by the internal combustion engine, the water propulsion device drawing water through an intake duct disposed apart from the opening in the hull, and a lubrication system including a pump device and a reservoir having an outer surface, the lubrication system communicating with the engine so as to supply lubricant thereto with the pump device circulating lubricant between at least the cylinder head of the engine and the reservoir, the reservoir being positioned in the hull relative to the opening such that ambient water in which the watercraft floats can contact at least a portion of the outer surface of the reservoir through the opening.

2. The watercraft of claim 1, wherein at least a portion of the outer surface of the reservoir extends through the opening.

3. The watercraft of claim 1, wherein the reservoir is secured to the hull such that the hull is sealed in a watertight manner about the opening.

4. The watercraft of claim 1, wherein the reservoir further comprises at least one heat sink formed in an outer wall of the reservoir, the heat sink extending through the opening and into the ambient water.

5. The watercraft of claim 4, wherein the heat sink comprises a vane which extends outward from the reservoir.

6. The watercraft of claim 4, wherein the heat sink comprises a highly thermal conductive material.

7. The watercraft of claim 1, wherein the reservoir is disposed in the hull such that at least another portion of the outer surface of the reservoir is exposed to ambient air entering the engine compartment.

8. The watercraft of claim 1, wherein the engine includes a crankcase, and the reservoir is disposed apart from the crankcase of the engine.

9. The watercraft of claim 1, wherein the engine includes a crankcase, and the reservoir forms at least a portion of the crankcase.

10. The watercraft of claim 1, wherein the portion of the outer surface of the reservoir is defined at least in part by at least a portion of a heat-conductive metal mounting plate.

11. The watercraft of claim 1 additionally comprising a cooling system including at least one coolant jacket in contact with at least a portion of the reservoir.

12. The watercraft of claim 11, wherein the cooling system further comprises a coolant delivery system that transfers cooling water from the water propulsion device to the coolant jacket and discharges the cooling water to a discharge port of the watercraft.

13. The watercraft of claim 11, wherein the coolant jacket communicates with a tell tale port.

14. The watercraft of claim 1, wherein the opening is disposed forward of an inlet to the water propulsion device.

15. The watercraft of claim 14, wherein the opening is disposed so as to be raised above the surface of the water when the watercraft is up on plane.

16. A small watercraft comprising a hull with an engine compartment defined therein, the hull having a lower section of the hull that defines at least a portion of a planing surface of the watercraft, an internal combustion engine mounted in the engine compartment and including a cylinder head, a water propulsion device powered by the internal combustion engine, and a lubrication system including a pump device and a reservoir, the lubrication system communicating with the engine so as to supply lubricant thereto with the pump device circulating lubricant between at least the cylinder head of the engine and the reservoir, the reservoir forming part of the lower hull section.

17. A small watercraft comprising a hull with an engine compartment, an internal combustion engine mounted in the engine compartment and including a cylinder head, a water propulsion device being powered by the internal combustion engine and having an intake duct, and a lubrication system including a pump device and a reservoir, the lubrication system communicating with the engine so as to supply lubricant thereto with the pump device circulating lubricant between at least the cylinder head of the engine and the reservoir, the reservoir extending at least partially about the impeller shaft, and at least a portion of the reservoir forming a portion of the intake duct for the water propulsion device.

18. The watercraft of claim 17, wherein the reservoir completely envelopes the impeller shaft.

19. The watercraft of claim 17, wherein the reservoir extends above the impeller shaft.

* * * * *